United States Patent [19]

Kurisu et al.

[11] 4,074,979

[45] Feb. 21, 1978

[54] THERMAL DECOMPOSITION APPARATUS

[75] Inventors: Shingo Kurisu; Toshiya Oyamoto, both of Mihara; Setumi Ochiai, Fukuyama; Hiromu Miyamoto, Onomichi; Katsuaki Makino, Mihara, all of Japan

[73] Assignee: Mitsubishi Jukogyo Kabushiki Kaisha, Tokyo, Japan

[21] Appl. No.: 637,979

[22] Filed: Dec. 5, 1975

Related U.S. Application Data

[63] Continuation-in-part of Ser. No. 571,988, April 28, 1975, abandoned, which is a continuation of Ser. No. 391,017, Aug. 28, 1973, abandoned.

[51] Int. Cl.[2] ..... C10J 3/20

[52] U.S. Cl. ..... 48/111; 48/209; 201/25

[58] Field of Search ..... 48/111, 209, 202; 201/2.5, 25; 202/198, 161, 185 E, 160, 105, 120; 203/53, 87, 35; 23/264, 281

[56] References Cited

U.S. PATENT DOCUMENTS

| | | | |
|---|---|---|---|
| 2,501,326 | 3/1950 | Gilmore | 202/198 |
| 3,451,895 | 6/1969 | Webb | 202/160 |
| 3,832,151 | 8/1974 | Kitaoka | 48/209 |
| 3,843,339 | 10/1974 | Saito | 48/209 |

FOREIGN PATENT DOCUMENTS

| | | | |
|---|---|---|---|
| 2,345,750 | 1/1975 | Germany. | |
| 1,413,870 | 11/1975 | United Kingdom | 48/209 |

*Primary Examiner*—Robert L. Lindsay, Jr.
*Assistant Examiner*—Peter F. Kratz
*Attorney, Agent, or Firm*—Toren, McGeady and Stanger

[57] ABSTRACT

Waste material heated in the bottom of a thermal decomposition furnace is vaporized to create gas flow upwardly within the furnace. Cooling means located to have the upwardly flowing gas pass thereacross operates to control the temperature of the gas leaving the furnace through the upper end thereof so that gaseous product having a boiling point above the boiling point induced by the cooling means will condense and fall within the furnace onto tray means located below the cooling means and adapted to receive therein condensed liquid from the cooling means. The tray means include orifice means for enabling upwardly flowing gas to come into contact with the liquid received in the tray means, and downflow tubes for causing liquid within the tray means to flow downwardly to the bottom of the furnace into contact with heating means. Gas flowing upwardly from the heating means passes through the orifice means and into contact with the liquid in the tray means. By adjustment of the temperature of the cooling means above the tray means, exit gas flow is controlled to prevent clogging of the exhaust portions of the apparatus by solidification of the decomposition product.

4 Claims, 2 Drawing Figures

THERMAL DECOMPOSITION APPARATUS

This application is a continuation-in-part of our prior application Ser. No. 571,988 filed Apr. 28, 1975 which is, in turn, a continuation of our application Ser. No. 391,017 filed Aug. 28, 1973, now both abandoned.

BACKGROUND OF THE INVENTION

The present invention relates generally to apparatus for the thermal decomposition of waste materials and more particularly to apparatus for treating organic wastes and for converting such waste into a gaseous decomposition product.

In the thermal decomposition of organic waste materials, a variety of hydrocarbons are produced in each process which is utilized. These may include products in a gaseous form as well as products constituting a relatively rigid waxy form at normal temperatures. As a result, compounds having a large number of carbon atoms will be deposited upon the walls of tubing or condenser means in the apparatus resulting from cooling of the compositions involved. Because of condensation or solidification resulting from such cooling, blockage of tubes or condensers will result.

As a result it has been found desirable to prevent such blocking by provision of a cooling layer in the gas phase of a reactor or decomposition furnace in order that the heavier products of the decomposition do not flow in the exhaust portions of the apparatus. The heavy products may be separated through condensation and they may be returned to the reactor or decomposition furnace in order to be converted into materials of lower molecular weight.

When the aforementioned processes are carried out through a fractional condenser outside of the reactor, piping running to the fractional condenser may become blocked thereby causing difficulty in the treatment of condensates.

Thus, the present invention is directed to the provision of decomposition apparatus which will prevent blockage from occurring in the exhaust portions of the apparatus. The apparatus of the present invention is intended to effect control of the decomposition exhaust gas product in order to insure that the gaseous product flowing through the exhaust portions of the apparatus will have a boiling point which is low enough to prevent solidification or condensation of the product by inherent cooling which may occur in the exhaust portions of the apparatus.

SUMMARY OF THE INVENTION

Briefly, the present invention may be described as thermal decomposition apparatus for converting waste material into gaseous products which comprises a housing having generally upstanding wall means defining a furnace interior with an upper part and a lower part. A decomposition product gas outlet port is located at the upper part of the furnace and solid residue may be discharged from discharge means located at the lower part of the furnace. The apparatus of the invention includes heating means located in the lower part of the furnace for heating waste materials introduced into the furnace to effect vaporization of the heated waste materials thereby creating gas flow of the vaporized product upwardly within the furnace. Cooling means located within the upper part of the furnace are arranged to have the upwardly flowing gas pass there-across in order to change the temperature of the gas in accordance with the temperature of the cooling means. Control means are provided for controlling the temperature of the cooling means to maintain the temperature of the gas flowing thereacross at a predetermined maximum level thereby to effect condensation of the components of the gas having a boiling point above said maximum level. Tray means extending across the furnace are located between the cooling means and the heating means. As a result, condensed liquid formed in the cooling means will drop onto the tray means and tend to become accumulated therein. The tray means include orifices through which gas may flow upwardly through the tray means from the heating means thereby causing the upwardly flowing gas to be brought into contact with the liquid accumulated within the tray means. The tray means also include downflow tubes which direct liquid flow from the tray means downwardly toward the heating means thereby bringing the downwardly flowing liquid into contact with the heating means to effect further vaporization thereof.

By control of the temperature of the cooling means, the boiling point of gas leaving the decomposition furnace may be controlled. The cooling means operates to maintain the maximum boiling point of the components of the exhaust gas at a sufficiently low level to prevent blockage of the exhaust portion of the apparatus by solidification of the exhaust decomposition product.

In the operation of the apparatus of the invention, the organic waste material charged to the furnace is heated by the heating means to a temperature capable of affecting its decomposition. The decomposition product gases thus produced are cooled by the cooling means in the upper part of the furnace and flow in the direction of the exhaust port of the furnace with the heavier products contained in the exhaust flow being condensed and separated therefrom. The condensed components are returned to the heating means of the furnace and are again decomposed while gas passed through the cooling portion of the furnace is permitted to exhaust through the outlet part at the upper part of the furnace. Decompsition residue may be continuously removed from the exhaust elements of the furnace.

In the apparatus according to the invention, the cooling means provided in the upper part of the furnace controls the exhaust temperature of the gases and prevents or inhibits the heavier products of the decomposition product gas from flowing into the exhaust elements of the apparatus. Thus, the exhaust elements of the apparatus will not tend to become blocked by solidification of decomposition product which might otherwise occur therein. By adjusting the temperature at which the cooling means of the furnace is operated, it is possible to control the range of boiling points of the thermal composition product which is obtained. Thermal decomposition product having a high boiling point is liquidfied by the cooling means and falls back into the furnace to be again subjected to thermal decomposition. Thermal decomposition products having lower boiling points will remain in their gaseous phase after passing through the cooling means and will exit from the furnace without tending to cause blockage thereof. Accordingly, it will be possible to remove from the furnace thermal decomposition product at a temperature at which the cooling device is operated thereby maintaining unimpeded operation of the apparatus.

The various features of novelty which characterize the invention are pointed out with particularity in the claims annexed to and forming a part of this disclosure. For a better understanding of the invention, its operating advantages and specific objects attained by its use, reference should be had to the accompanying drawing and descriptive material in which there are illustrated and described preferred embodiments of the invention.

DETAILED DESCRIPTION OF THE PREFERRED EMBODIMENTS

Figure 1:
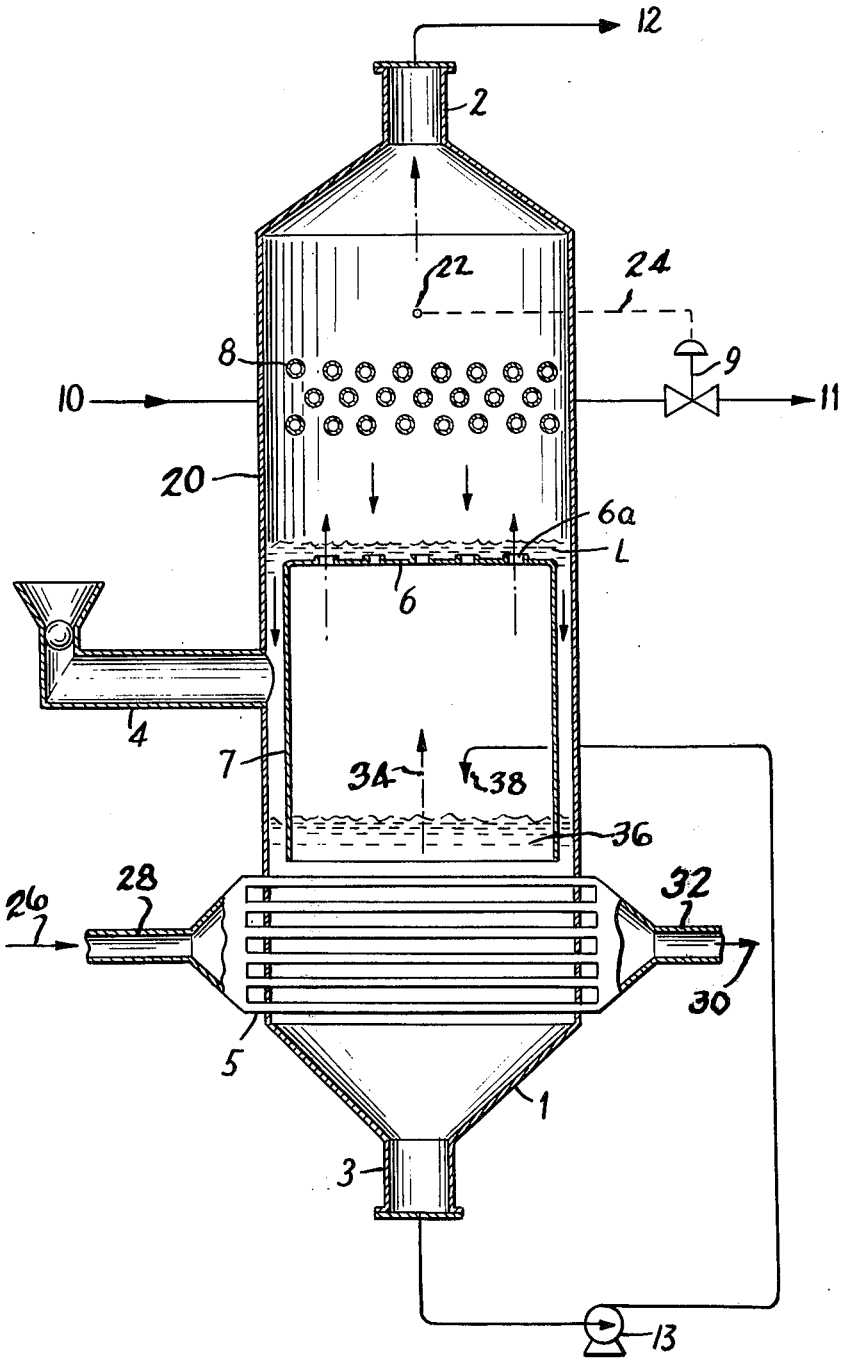
FIG. 1 is a longitudinal sectional view schematically showing one embodiment of the thermal decompositon apparatus of the invention.

Referring now to the drawings, wherein like reference numerals are used to refer to similar parts throughout the figures thereof, the embodiment of the invention depicted in FIG. 1 is shown as comprising a thermal decomposition reaction furnace 1 having at the upper end thereof a decomposition product exhaust port 2 and, at the bottom end thereof, a decomposition product residue outlet port 3. The furnace 1 is structured to include upstanding wall means 20 defining the furnace with an upper part and a lower part with feeder means 4 being provided to enable the introduction of organic waste products into the interior of the furnace through the wall means 20.

Heating means 5 are arranged at the lower part of the furnace 1 and tray means 6 are located to extend across the furnace above the heating means 5.

The tray means 6 include means defining therethrough orifices *6a* with downflow tubes 7 being provided to enable liquid flow downwardly from the tray means 6.

The decomposition product gases leave the furnace through exhaust elements of the apparatus schematically indicated at 12 which may include condenser means (not shown).

Cooling means 8 are located at the upper part of the furnace and the gaseous products flowing upwardly through the furnace are caused to pass through the cooling means 8 whereby the temperature of the gas may be controlled. Thus, the gas exhaust through the outlet port 2 is first passed across the cooling means 8 in order to enable control of the exhaust gas temperature by control of the temperature of the cooling means 8.

The cooling means 8 consists of a plurality of generally horizontally extending tubes arranged at substantially equal intervals across the upper part of the furnace 1. The cooling means 8 may be formed as a single continuous tube which is bent to traverse the cross-section of the furnace in a generally serpentine configuration or a plurality of discontinuous tubes may be provided with each of the tubes having a cooling medium flowing therethrough.

The cooling medium, which may constitute cooling water, is introduced into the cooling means 8 by inlet means 10 and an automatic control valve 9, which may be of the electromagnetic type, the pneumatic type or of the hydraulic type, controls the quantity of cooling water flowing through the cooling means 8 to cooling medium outlet means 11. Temperature sensing means 22 located in the upper part of the furnace above the cooling means 8 operate to sense the temperature of the gas leaving the cooling means 8 and a control connection 24 is provided between the temperature sensing means 22 and the control valve 9 in order to effect control of the cooling medium within the cooling means 8 in response to the temperature of the gas sensed by the temperature sensing means 22. The temperature sensing means 22 may comprise a suitable thermometer which may by of the expansion type, the EMF-type or the resistance type. Thus, by controlling the quantity of cooling water flowing through the cooling means 8, it becomes possible to adjust the ambient temperature of the cooling means 8 thereby controlling the temperature of gas flowing past the sensing means 22.

The heating means 5 comprise a multi-tube heating device through which hot exhaust gases are caused to flow at high temperatures. The hot exhaust gases enter at 26 through an inlet tube 28 and they leave the heating means 5 at 30 through an exhaust tube 32. Because of the high temperature of the gasses flowing through the heating means 5, the waste material introduced into the furnace through the feeder means 4 will be dissolved or vaporized with the vapors thus created causing generation of gas flow indicated by the arrow 34 upwardly of the furnace 1. The dissolved waste materials introduced into the furnace form, as a result of operation of the heating means 5, a dissolving bath 36 at the lower end of the furnace. In order to maintain the dissolving bath 36 in an agitated condition, agitation means are provided which may comprise a circulation pump 13 which draws liquid from the dissolving bath 36 and recirculates the liquid externally of the furnace 1 with the recirculated liquid being subsequently reintroduced into the dissolving bath 36 at the point 38. Alternatively, the agitation means may comprise gas stirring effected by means of introduction of evolved gaseous flow in the dissolving bath (now shown in the drawing) or a thermal syphon (not shown) may be utilized by utilization of the temperature level of the dissolving bath thereby to effect the agitation of the bath.

In the operation of the apparatus of the present invention, synthesized high molecular waste material is supplied through the feeder means 4 into the furnace 1 above the heating means 5. The waste drops downwardly into the furnace and into the dissolving bath 36. The waste material will become mixed with the dissolving bath by mechanical action by virtue of the fact that the density of the supplied material is greater than that of the dissolving bath. Moreover, due to the multiplicative action of the downward momentum of the supplied material and of the agitation and stirring action caused by the operation of the apparatus, the supplied material will, in its downwardly moving path, pass among the tubes of the heating means 5 and become heated and decomposed. Its viscosity will be lowered and it will eventually become dissolved forming part of the dissolving bath. The resulting material will be withdrawn from the exhaust port 3 of the decomposition furnace and will be returned to the surface of the dissolving bath by circulation pump 13.

During repetition of this recycling operation, the decomposed constituents of the waste material having low molecular weight are evaporated and the thermally decomposed gas thus produced moves upwardly within the furnace to the cooling means 8. Furthermore, as a result of the agitating action of the apparatus, the effectiveness of heat transmission occurring between the heating means 5 and the dissolving bath 36 is improved and accumulation of carbon on the surfaces of the heating tubes of the heating means 5 may be prevented.

The decomposed gas evolved by the process of thermal decomposition of the organic waste which occurs in the heating means 5 in the lower part of the furnace rises upwardly toward the cooling means 8 and in its travel in this direction the gas passes through the small holes 6a in the tray means 6. Gas which has come in contact with the cooling means 8 is lowered in temperature as a result of heat transfer between the cooling means 8 and the upwardly rising gas and as a result constituents of the rising gas having a boiling point higher than the temperature evolved in the cooling means 8 will condense, form into liquid droplets which become deposited and received in the tray means 6. As a result a liquid level L will be formed in the tray means 6.

The upwardly rising gas passing through the small holes 6a of the tray means 6 will be brought into contact with the liquid L composed of the heavier constituents condensed by the cooling means 8. Thus, improved gas-liquid contact is effected by the structure of the tray means 6. Furthermore, parts of the gaseous constituents of the heavier materials having a boiling point higher than the temperature of the liquid will be condensed and the condensate thus produced together with the liquid L formed in the tray means 6 will pass through down-flow tubes 7 to be returned to the heating means 5 for further thermal decomposition.

Alternatively, the balance of the gaseous constituents, including lighter constituents and some heavier constituents will rise upwardly until they reach the cooling means 8 where, again, gaseous constituents having a boiling point higher than the ambient temperature of the cooling means 8 will be condensed and returned in liquid form to the tray means 6.

As a result, only the lighter non-condensed gaseous constituents will be passed in gaseous form beyond cooling means 8 to be conducted outwardly through the product exhaust port 2 for subsequent recovery in the decomposition apparatus.

As a result of the action of the cooling means 8 and of the tray means 6 repeated recycling and thermal decomposition of the heavier materials will be insured. Since only the lighter materials or those having relatively low boiling points will be passed through the exhaust portions of the decomposition apparatus, blockage outside of the furnace due to condensation or solidification of heavier boiling point constituents will be avoided. Thus, the gas flowing in the condenser means and associated piping located externally of the furnace 1 beyond the exhaust port 2 will not solidify as a result of subsequent cooling in these portions of the apparatus and blockage by such solidification will be prevented.

It will be understood that by adjusting the cooling temperature of the cooling means 8 it will be possible to control the upper limit of the range of boiling points of the material to be recovered. Furthermore, it will be possible to vary in a predetermined manner the boiling points of materials exhausted from the furnace 1. Thus, it will be seen that materials having boiling points of a desired predetermined level may be recovered by appropriate adjustment of the apparatus.

Furthermore, it will be seen that the combined action of the cooling means 8 and the tray means 6 will enhance the gas-liquid contact which occurs within the apparatus and this will promote the desired decomposition action of the furnace. The heavy constituents of higher boiling point which are returned to the tray means 6 must be suitably decomposed in order to prevent their repeated recycling within the furnace. If the apparatus of the present invention were not provided, it is possible that when the higher boiling point constituents became once again evaporated after their downward fall into the tray means 6 or into the heating means 5, they would merely continue to be recycled within the furnace so that failure of suitable decomposition action of these constituents might result. However, with the combined action of the elements of the present invention, and by virtue of the enhanced gas-liquid contact which occurs within the furnace, such a stagnating effect within the apparatus will be reduced. Thus, not only will there be enabled control of the boiling points of the gas which is emitted from the furnace but there will also be provided enhanced decomposition action by the overall interrelationships of the elements of the invention.

Figure 2:
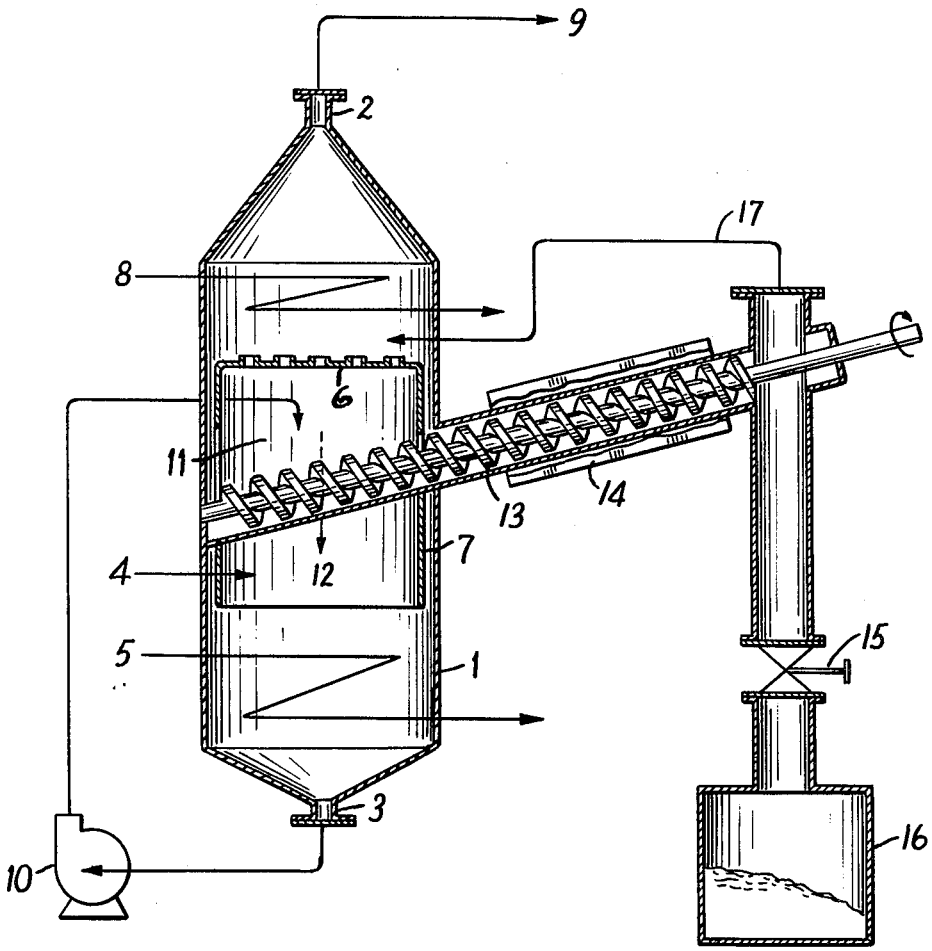
FIG. 2 is a sectional view showing a second embodiment of the invention.

A second embodiment of the invention is depicted in FIG. 2 of the drawings. As previously pointed out, the apparatus of the present invention is intended for treating organic waste material and particularly synthesized high molecular waste material. In order to continuously accomplish thermal decomposition of the waste, carbon and inorganic materials such as filler, pigments, and the like must be removed since these materials may become accumulated in the decomposing liquid. Accordingly, the operation of such a device will be further enhanced if a more positive approach is taken toward removing or recycling the residue within the apparatus.

In the embodiment depicted in FIG. 2, parts similar to those shown in connection with the embodiment of FIG. 1 have been assigned like reference numerals. In the operation of the embodiment of FIG. 2, a constant amount of liquid-containing solids is withdrawn from the residue exhaust port 3 provided at the bottom of the decomposition furnace by operation of a pump 10. The residue is then separated into a liquid constituent and a solid constituent by suitable solid-liquid separating means which may comprise a centrifugal separator, a filter, a densifier or the like. The liquid constituents are returned to the heating portion. In the embodiment of FIG. 2 there is preferably provided a densifier located for operation in cooperation with the furnace 1. In FIG. 2, the decomposition furnace 1, the product exhaust port 2, the residue exhaust port 3, the feeder means 4, the heating means 5, the tray means 6, the downflow tubes 7, and the cooling means 8 are similar to similarly numbered elements shown in FIG. 1.

The liquid product produced during thermal decomposition generally contains some solid material in the residue which is withdrawn from the residue exhaust port 3. This residue is recycled to a residue receiving portion of the furnace indicated by the reference numeral 11 and provided within the gas phase portion of the apparatus between the tray means 6 and the heating means 5. The residue is withdrawn by the pump 10 and recycled into the residue receiving portion 11 where solids are precipitated and separated from the liquid with the liquid thereafter overflowing to the heating means 5 as indicated by arrow 12 in FIG. 2.

However, precipitated solids are removed by means of a screw conveyor 13 which operates to move the solids through auxiliary heating means 14 wherein any liquid adhering to the removed solids will be vaporized with the gas being returned to the decomposition furnace through a return line 17. Moreover, dried solids conveyed through the heating means 14 by the conveyor 13 will be fed to a residue reservoir 16 through an air-interruption device 15.

Thus, solidified material withdrawn from the residue exhaust port 3 will be recycled to the screw conveyor 13 by means of the pump 10 and by rotation of the screw conveyor 13, as indicated in FIG. 2, solid material will become deposited into the residue reservoir 16 while gaseous material evaporated from the solid material within the screw conveyor 13 by the auxiliary heating means 14 will be returned to the line 17 into the furnace 1 at a point below the cooling means 8 but above the tray means 6. In all other essential respects, the embodiment of FIG. 2 will operate essentially along the same lines as the embodiment described in connection with FIG. 1.

While specific embodiments of the invention have been shown and described in detail to illustrate the application of the inventive principles, it will be understood that the invention may be embodied otherwise without departing from such principles.

What is claimed is:

1. Thermal decomposition apparatus for converting waste materials into gaseous products having a predetermined maximum boiling point comprising furnace means having an upper part and a lower part, supply means for introducing waste materials into said furnace means, gas product exhaust means located at the upper part of said furnace, residue discharge means located at the lower part of said furnace, heating means located at the lower part of said furnace for heating said waste materials in said furnace to evolve a gas by thermal decomposition of said waste materials thereby to create gas flow upwardly within said furnace means, cooling means located at the upper part of said furnace arranged to have upwardly flowing gas passed thereacross to change the temperature of said gas in accordance with the temperature of said cooling means, control means for adjusting the temperature of said cooling means to maintain the temperature of gas flowing thereacross at a level not higher than a predetermined maximum temperature level thereby to effect condensation at said cooling means of the components of said gas having a boiling point above said maximum temperature level, temperature sensing means for sensing the temperature of gas flowing across said cooling means, said control means being responsive to said temperature sensing means to maintain the temperature of said cooling means at a level commensurate with the desired predetermined maximum temperature level of gas flowing thereacross, tray means extending across said furnace between said cooling means and said heating means to receive therein condensed liquid dropping from said cooling means, said tray means including means defining orifices therethrough for enabling gas flow through said tray means to cause said gas flow to be brought into contact with said liquid received within said tray means and downflow tubes extending from said tray means to direct liquid flow from said tray means downwardly toward said heating means thereby to bring said downwardly flowing liquid into contact with said heating means to effect vaporization thereof, densifier means located between said heating means and said tray means to remove from said furnace solid residue deposited on said densifier means, and recycling means for removing material from said residue discharge means of said furnace means and delivering said removed material onto said densifier means, with adjustment of the temperature of said cooling means operating to control the temperature of gas flowing through said gas exhaust means thereby to condense out of said gas any constituents having a boiling point higher than said predetermined maximum temperature level to prevent entry of such higher boiling point constituents into said exhaust means, said apparatus thereby operating to prevent clogging thereof by solidification of the decomposition product passing through the exhaust means of said apparatus.

2. Apparatus according to claim 1 wherein said cooling means comprise tubes extending laterally across said furnace means, means for effecting flow of a liquid cooling medium through said tubes, and means for controlling the flow of said cooling medium to adjust the temperature of said cooling means.

3. Apparatus according to claim 1 wherein said densifier means comprise a screw conveyor device.

4. Apparatus according to claim 3 including auxiliary heating means for vaporizing solid residue on said screw conveyor device and return gas flow means for delivering the gaseous products of said vaporization to said furnace between said tray means and said cooling means.

* * * * *